US006604954B2

(12) United States Patent
Chu et al.

(10) Patent No.: US 6,604,954 B2
(45) Date of Patent: Aug. 12, 2003

(54) POWER PLUG WITH SAFETY FEATURE

(75) Inventors: Kuen-Yan Chu, Taipei Hsien (TW); Yi-Te Ch, Taipei (TW)

(73) Assignee: Primax Electronics Ltd., Taipei Hsien (TW)

( * ) Notice: Subject to any disclaimer, the term of this patent is extended or adjusted under 35 U.S.C. 154(b) by 0 days.

(21) Appl. No.: 09/682,828

(22) Filed: Oct. 23, 2001

(65) Prior Publication Data

US 2003/0077930 A1 Apr. 24, 2003

(51) Int. Cl.[7] ..... H01R 13/44
(52) U.S. Cl. ..... 439/140; 439/106; 439/141
(58) Field of Search ..... 439/140, 141, 439/106

(56) References Cited

U.S. PATENT DOCUMENTS 4,340,267 A * 7/1982 Nukaga ..... 439/141
4,445,739 A * 5/1984 Wooten ..... 439/140
5,108,297 A * 4/1992 Hoffman et al. ..... 439/134
5,226,827 A * 7/1993 Corcoles et al. ..... 439/140
5,466,164 A * 11/1995 Miyazaki et al. ..... 439/140
6,176,712 B1 * 1/2001 Huang ..... 439/140
6,231,358 B1 * 5/2001 Kerr et al. ..... 439/140
6,328,597 B1 * 12/2001 Epps ..... 439/502
6,468,095 B2 * 10/2002 Kerr et al. ..... 439/140

* cited by examiner

*Primary Examiner*—Tho D. Ta
*Assistant Examiner*—James R. Harvey
(74) *Attorney, Agent, or Firm*—Winston Hsu

(57) ABSTRACT

A power plug has a housing, a voltage prong, a neutral prong, and a ground prong, the prongs set in the housing, and a main body elastically set in the housing and encircling the prongs. When plugging the power plug into a socket, the main body retracts toward the housing. When unplugging the power plug from the socket, the main body is pushed outward to cover the prongs. In such a manner, only a small section of each prong is exposed to open air or the prongs are not exposed at all, increasing the safety of the power plug.

6 Claims, 4 Drawing Sheets

POWER PLUG WITH SAFETY FEATURE

BACKGROUND OF INVENTION

1. Field of the Invention

The present invention relates to plugs, and more particularly, to a power plug with a main body safety feature.

2. Description of the Prior Art

Power plugs are one part of a two-part supply device used to transmit electrical power from a source wire to an electrically powered device. Instead of hardwiring the electrically powered device to the source wire, use of the jack device allows any electrically powered device comprising a power plug to be used anywhere there is a corresponding power outlet, barring a rare exception of power source incompatibility due to differing national standards.

Please refer to FIGS. 1 and 2, which show a power plug 10 and a power jack 20, according to the prior art. The power plug 10 comprises an outer casing 12, a neutral prong 14, a voltage prong 16, and a ground prong 18 set in the casing 12. The power jack 20 comprises a casing 22, and a plurality of openings 24 corresponding to the prongs 14, 16, and 18 of the power plug 10.

Being made of metal, when the prongs 14, 16, and 18 of the power plug 10 make connection with internal circuitry (not shown) of the power jack 20, electricity is conducted through the voltage prong 16 to power a device connected to the power plug 10. However, for appropriately long prongs, and appropriately small fingers, a gap left momentarily open, as the plug 10 is inserted into to the jack 20, can pose danger to a user of the supply. If the user were to accidentally use their fingers to close a circuit across the voltage prong 16 and either, or both of, the ground prong 18 and the neutral prong 14, a potentially fatal current could flow through the body of the user.

SUMMARY OF INVENTION

It is therefore an object of the present invention to provide a power plug with a safety measure in the form of a body that encloses prongs of the power plug.

Briefly, a power plug according to the claimed invention comprises an outer casing, a main body elastically installed on the casing, and a voltage prong and a neutral prong fixed inside the outer casing. The main body encircles the voltage prong and the neutral prong, such that when plugging in the power plug, the main body retracts to reveal the prongs, and when unplugging the power plug, the main body is pushed out to encircle the prongs.

It is an advantage of the claimed invention power plug that current carrying prongs are not left exposed, but instead are effectively covered both as the plug is plugged in, and as the plug is unplugged.

These and other objectives of the present invention will no doubt become obvious to those of ordinary skill in the art after reading the following detailed description of the preferred embodiment, which is illustrated in the various figures and drawings.

DETAILED DESCRIPTION

Figure 2:
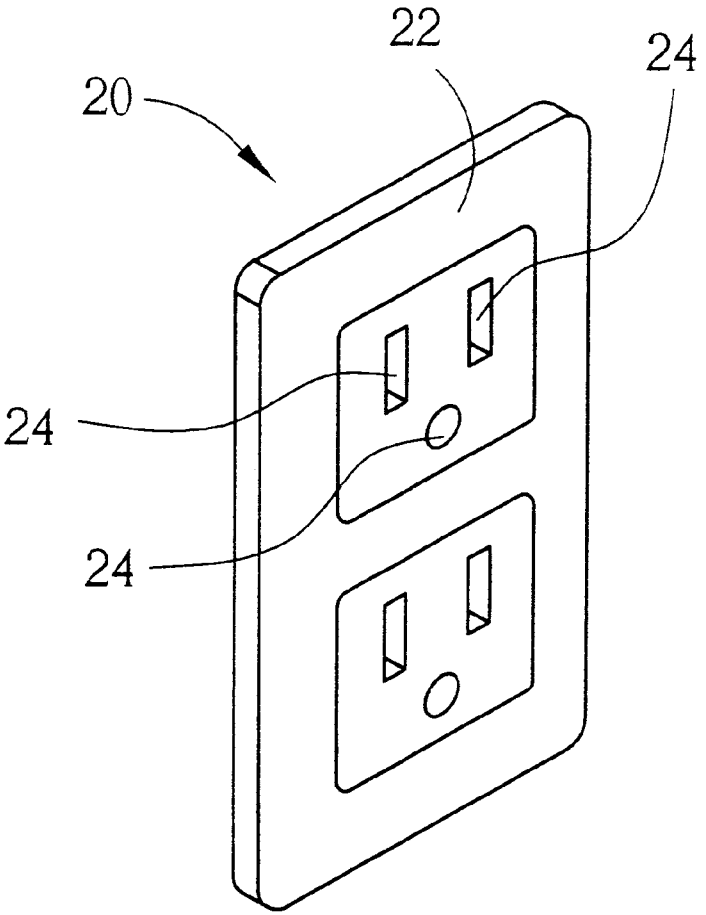
Fig. 2 Prior art
FIG. 2 is a perspective view of a prior art power jack.
Figure 1:
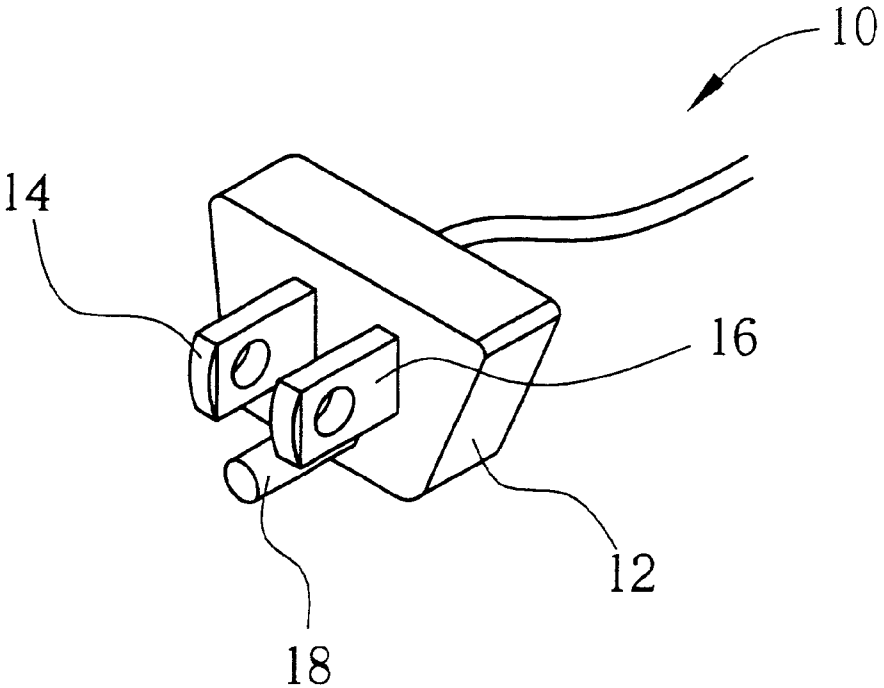
Fig. 1 Prior art
FIG. 1 is a perspective view of a prior art power plug.
Figure 4:
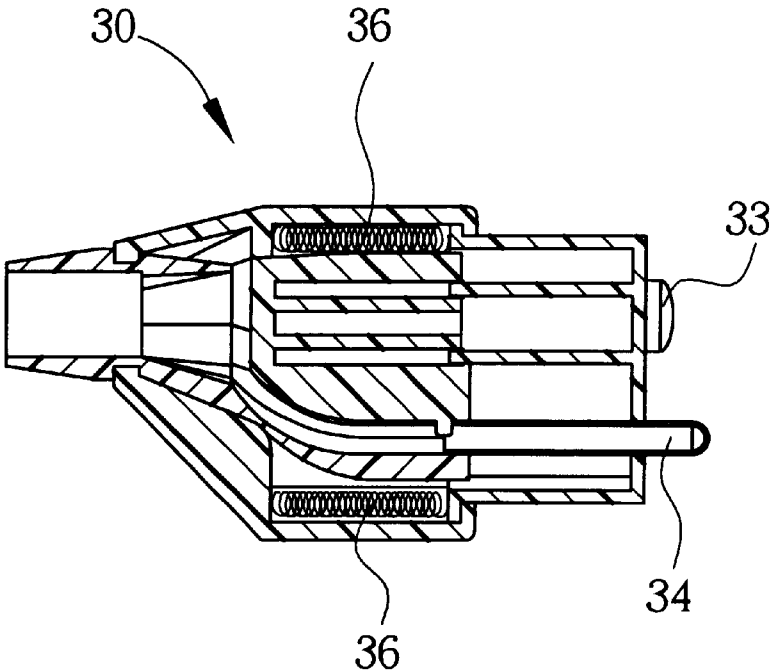
FIG. 4 is a cross-sectional view of the first power plug in FIG. 3.
Figure 3:
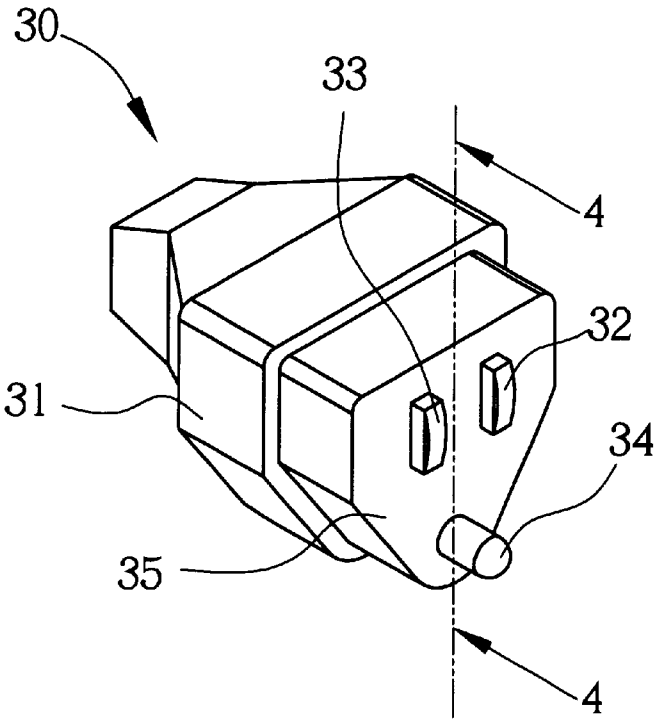
FIG. 3 is a perspective view of a first power plug according to the first embodiment of the present invention.

Please refer to FIGS. 3 and 4. FIG. 3 is a perspective view of a first power plug 30 according to the first embodiment of the present invention. FIG. 4 is a side view of the first power plug 30 along line 4—4. The power plug 30 comprises an outer casing 31, a neutral prong 32, a voltage prong 33, a ground prong 34, a main body 35, and two springs 36 acting as an elastic device. The prongs 32, 33, and 34 are all fixed inside the outer casing 31. The main body 35 is elastically installed on the outer casing 31, and encircles the prongs 32, 33, and 34, leaving a very short length of each of the prongs 32, 33, and 34 exposed to assist alignment with corresponding holes in a power jack (not shown). Of course, the main body 35 could be configured not to leave any portion of the prongs 32, 33, and 34 exposed, or to leave a longer length of the prongs 32, 33, and 34 exposed. The springs 36 are fixed at one end to the outer casing 31, and at another end to the main body 35. Please note that the springs 36 are only used as an example of an elastic device, and that many elastic devices are suitable for use in the present invention.

During a plugging in operation, the main body 35 is pushed in a direction toward the outer casing 31. This causes the springs 36 to contract. When unplugging, the springs 36 extend, thereby forcing the main body 35 in a direction away from the outer casing 31. Thus, the prongs 32, 33, and 34 are constantly enclosed by the main body 35, and not left exposed or only partially exposed.

Figure 6:
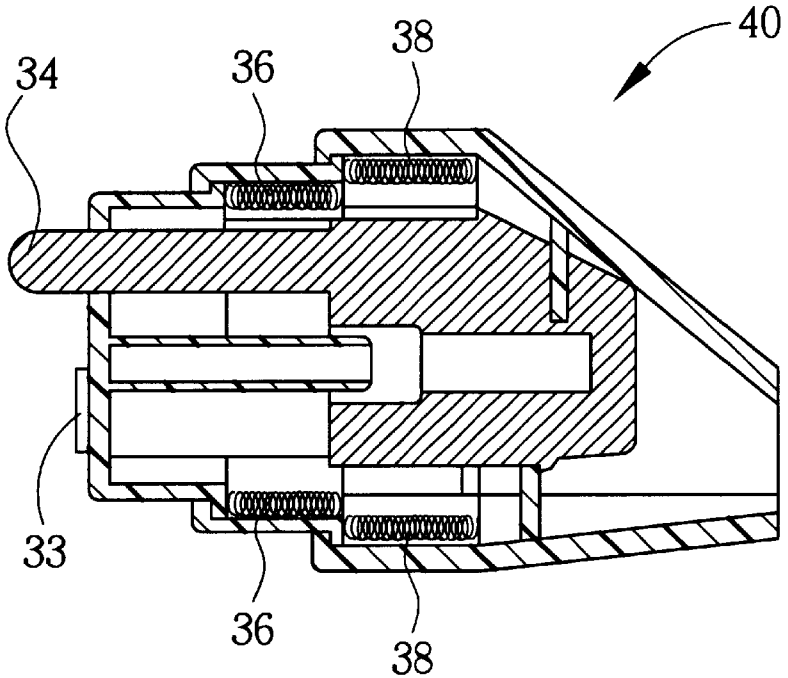
FIG. 6 is a cross-sectional view of the second power plug in FIG. 5.
Figure 5:
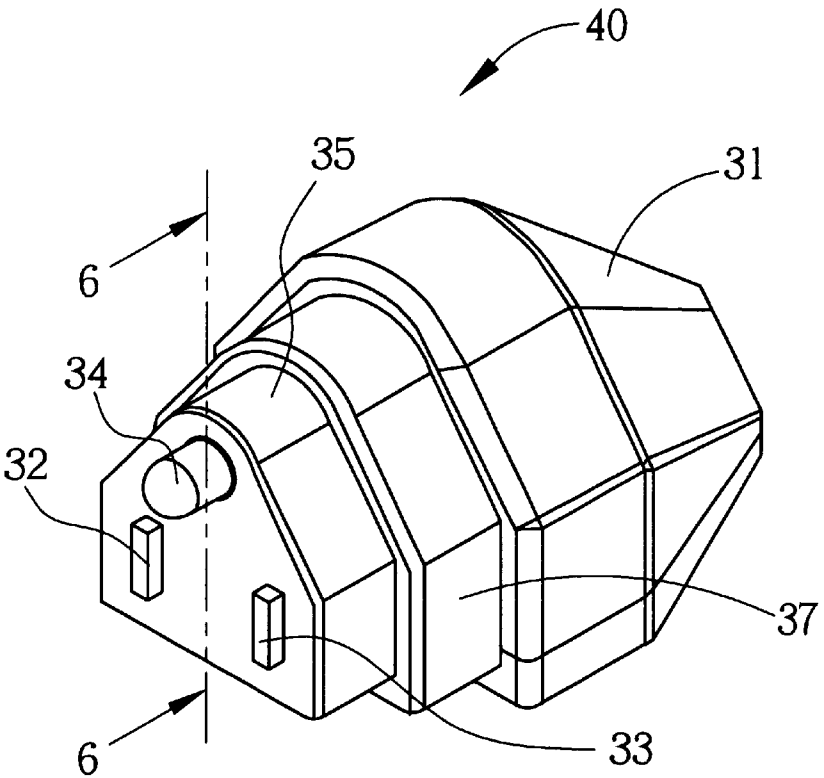
FIG. 5 is a perspective view of a second power plug according to the second embodiment of the present invention.

Please refer to FIGS. 5 and 6. FIG. 5 is a perspective view of a second power plug 40 according to the second embodiment of the present invention. FIG. 6 is a side view of the second power plug 40 along line 6—6. The difference between the first and second power plugs 30, 40 is that the second power plug 40 further comprises a sleeve 37 installed between the main body 35 and the outer casing 31, and two springs 38 connected to the sleeve 37. The springs 38 provide a force upon the sleeve 37 when unplugging the power plug 40, such that only a small section of each prong 32, 33, 34 is left exposed or the prongs 32, 33, 34 are not exposed at all. Please note that the springs 36 are still connected to the main body 35 in this embodiment.

Figure 7:
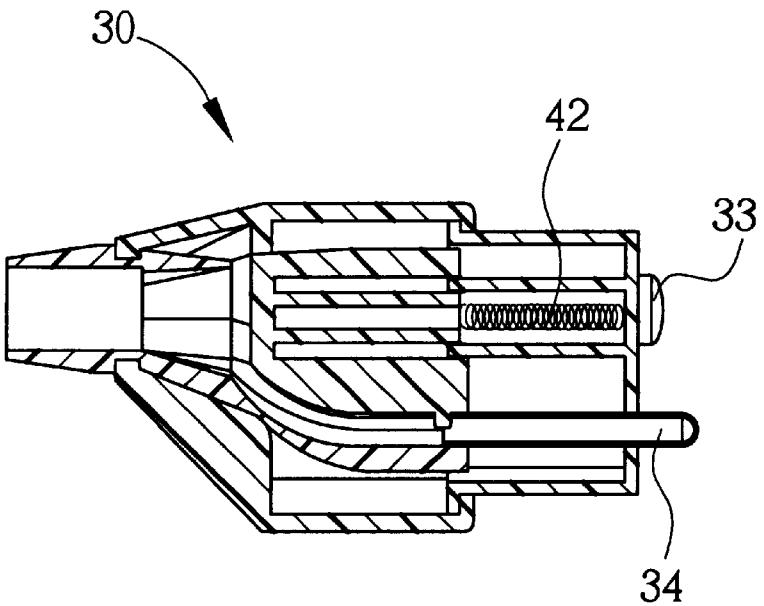
FIG. 7 is a cross-sectional view of the first power plug in FIG. 3 according to the third embodiment of the present invention.

Please refer to FIG. 7. FIG. 7 is a cross-sectional view of the first power plug 30 along line 4—4 according to the third embodiment of the present invention. The main body 35 of the first power plug 30 can be retracted and extended by any retractable mechanism. The first embodiment was shown in FIG. 4 where two springs 36 are connected between the outer casing 31 and the main body 35. FIG. 7 shows the third embodiment of the present invention where a central spring 42 is used to retract and extend the main body 35 of the first power plug 30. The central spring 42 is connected at one end to the outer casing 31 and at the other end to the main body 35. In contrast to the first embodiment illustrated in FIG. 4, the third embodiment uses only the single central spring 42 instead of two springs 36 for the retractable mechanism.

Although not shown, another embodiment could include three springs. If desired, the two springs 36 from FIG. 4 and the central spring 42 could all be used together for controlling the retractable mechanism.

Figure 8:
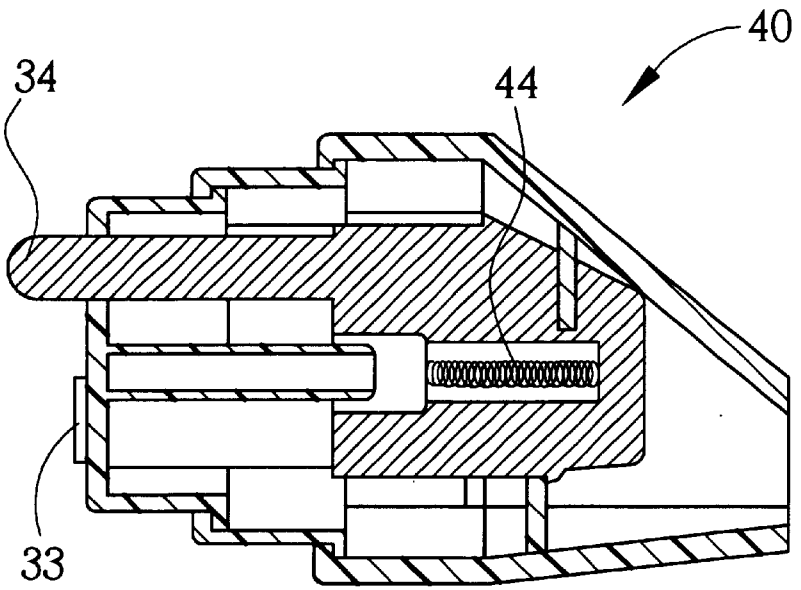
FIG. 8 is a cross-sectional view of the second power plug in FIG. 5 according to the fourth embodiment of the present invention.

Please refer to FIG. 8. FIG. 8 is a cross-sectional view of the second power plug 40 along line 6—6 according to the fourth embodiment of the present invention. The main body 35 of the second power plug 40 can be retracted and extended by any retractable mechanism. The second embodiment was shown in FIG. 6 where two springs 36 are used to extend the main body 35 and two springs 38 were used to extend the sleeve 37. FIG. 8 shows the forth embodiment of the present invention where a central spring 44 is used to retract and extend the main body 35 of the second power plug 40. The central spring 44 is connected at one end to the outer casing 31 and at the other end to the main body 35. In contrast to the second embodiment illustrated in FIG. 6, the fourth embodiment uses only the single central spring 44 instead of four springs 36, 38 for the retractable mechanism. Although not shown, another embodiment could include up to five springs. If desired, the four springs 36, 38 from FIG. 6 and the central spring 42 could all be used together for controlling the retractable mechanism.

The four embodiments listed above all include a retractable mechanism that involves an outer casing 31 and a main body 35. The main body 35 retracts into and extends out of the outer casing 31 in order to limit the chance of electrocution due to contact with the electrical prongs. In addition to this arrangement, other retractable mechanisms can be used. For example, a drainage pipe commonly used with a washing machine could also be used to limit the exposure to the electrical prongs. The retractable, accordion-like nature of the drainage pipe would allow retraction when the plug is inserted into an electrical outlet. Likewise, the drainage pipe would also extend out over the prongs as the plug is being unplugged from the electrical outlet. The drainage pipe is just one example of other possible retractable mechanisms for this invention. These examples are not meant as limiting to the scope of this invention.

Compared to the prior art power plug, the power plug of the present invention has the main body that encircles the charge carrying prongs of the power plug. Regardless of plugging or unplugging motions, the prongs of the power plug are not left exposed or are only partially exposed, making the present invention power plug safer for use.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A power plug comprising:

an outer casing;

a neutral prong and a voltage prong fixed inside the outer casing;

a main body elastically installed on the outer casing encircling the neutral prong and the voltage prong; and a sleeve installed between the main body and the outer casing;

wherein when the power plug is pushed toward a power outlet, the main body is and the sleeve are both retracted toward the outer casing; and when the power plug is pulled away from the power outlet, the main body and the sleeve are both pushed away from the outer casing.

2. The power plug of claim 1 further comprising a ground prong encircled by the main body.

3. The power plug of claim 1 further comprising an elastic device for pushing the main body away from the outer casing.

4. The power plug of claim 3 wherein the elastic device is a spring.

5. The power plug of claim 1 further comprising an elastic device for pushing the sleeve away from the outer casing.

6. The power plug of claim 5 wherein the elastic device is a spring.

* * * * *